US007598683B1

(12) United States Patent
Jalbout et al.

(10) Patent No.: US 7,598,683 B1
(45) Date of Patent: Oct. 6, 2009

(54) CONTROL OF LIGHT INTENSITY USING PULSES OF A FIXED DURATION AND FREQUENCY

(75) Inventors: Bassam D. Jalbout, Mont-Royal (CA); Brian Wong, Kirkland, CA (US)

(73) Assignee: LSI Industries, Inc., Cincinnati, OH (US)

( * ) Notice: Subject to any disclaimer, the term of this patent is extended or adjusted under 35 U.S.C. 154(b) by 199 days.

(21) Appl. No.: 11/882,323

(22) Filed: Jul. 31, 2007

(51) Int. Cl.
*H05B 37/02* (2006.01)

(52) U.S. Cl. ..... 315/291; 315/307; 315/360; 315/362; 315/312

(58) Field of Classification Search ..... 315/291, 315/292, 307, 312, 360, 362, 209 R; 363/97
See application file for complete search history.

(56) References Cited

U.S. PATENT DOCUMENTS 4,090,189 A 5/1978 Fisler
4,163,969 A 8/1979 Enemark
4,284,884 A 8/1981 Dyment et al.
4,388,558 A 6/1983 Mizuno et al.
4,675,575 A 6/1987 Smith et al.
4,750,837 A 6/1988 Gifford et al.
4,802,768 A 2/1989 Gifford et al.
5,184,114 A 2/1993 Brown
5,317,307 A 5/1994 Thomas, Jr.
5,489,771 A 2/1996 Beach et al.
5,519,496 A 5/1996 Borgert et al.
5,872,474 A 2/1999 Kagomiya et al.
6,016,038 A * 1/2000 Mueller et al. ..... 315/291
6,150,771 A * 11/2000 Perry ..... 315/291
6,150,774 A 11/2000 Mueller et al.
6,157,661 A * 12/2000 Walker et al. ..... 372/38.02
6,163,275 A 12/2000 Hartzell
6,211,626 B1 4/2001 Lys et al.
6,222,172 B1 4/2001 Fossum et al.
6,305,818 B1 10/2001 Lebens et al.
6,308,052 B1 10/2001 Jamali et al.
6,340,868 B1 1/2002 Lys et al.
6,367,180 B2 4/2002 Weiss et al.
6,488,390 B1 12/2002 Lebens et al.
6,504,334 B2 1/2003 Sogawa
6,510,995 B2 1/2003 Muthu et al.
6,515,584 B2 2/2003 DeYoung
6,548,967 B1 4/2003 Dowling et al.
6,577,080 B2 6/2003 Lys et al.
6,580,309 B2 6/2003 Jacobs et al.
6,608,453 B2 8/2003 Morgan et al.
6,624,597 B2 9/2003 Dowling et al.
6,667,869 B2 12/2003 Greenberg
6,693,395 B2 2/2004 Wilhelm
6,724,376 B2 4/2004 Sakura et al.

(Continued)

*Primary Examiner*—Haissa Philogene
(74) *Attorney, Agent, or Firm*—McDermott Will & Emery LLP

(57) ABSTRACT

A method and circuit to control the intensity of lights, illumination fixtures, and displays using pulses of a fixed duration and a fixed frequency (FD/FF) is provided. In particular, the method may be used to control one more light sources. By varying the number of pulses in a control burst, the total current flowing through the light source may be precisely controlled providing greater accuracy than other methods, such as, for example, PWM or variable pulse frequency. The FD/FF technique may be used in conjunction with any number of light sources, and finds particular application in LED displays and for any type of LED illumination fixture.

19 Claims, 10 Drawing Sheets

U.S. PATENT DOCUMENTS 6,786,625 B2 9/2004 Wesson
6,788,011 B2 9/2004 Mueller et al.
6,808,287 B2 10/2004 Lebens et al.
6,819,303 B1 11/2004 Berger et al.
6,841,947 B2 1/2005 Berg-johansen
6,935,595 B2 8/2005 Butsch et al.
6,957,897 B1 10/2005 Nelson et al.
6,963,175 B2 11/2005 Archenhold et al.
6,965,205 B2 11/2005 Piepgras et al.
6,967,445 B1 11/2005 Jewell et al.
6,975,079 B2 12/2005 Lys et al.
6,987,787 B1 1/2006 Mick
6,988,820 B2 1/2006 Drufva
7,005,646 B1 2/2006 Jordanov et al.
7,009,440 B2 3/2006 Nogawa et al.
7,014,336 B1 3/2006 Ducharme et al.
7,015,825 B2 3/2006 Callahan
7,038,399 B2 5/2006 Lys et al.
7,038,594 B2 5/2006 Voreis et al.
7,057,153 B2 6/2006 Linge et al.
7,071,894 B1 7/2006 Thielemans et al.
7,091,874 B2 8/2006 Smithson
7,095,002 B2 8/2006 Kong et al.
7,102,801 B2 9/2006 Bliley et al.
7,113,541 B1 9/2006 Lys et al.
7,119,498 B2 10/2006 Baldwin et al.
7,123,211 B2 10/2006 Nowatzyk
7,129,652 B2 10/2006 Patel et al.
7,135,824 B2 11/2006 Lys et al.
7,161,311 B2 1/2007 Mueller et al.
7,164,364 B2 1/2007 Ares Losada
7,180,252 B2 2/2007 Lys et al.
7,183,723 B2 2/2007 Yu et al.
7,186,000 B2 3/2007 Lebens et al.
7,265,499 B2 * 9/2007 Ball ..... 315/282
7,414,862 B2 * 8/2008 Park ..... 363/16
2003/0016198 A1 * 1/2003 Nagai et al. ..... 345/83

* cited by examiner

Actual Waveform of Fixed Duration / Fixed Frequency Pulse

Total Current for one Pulse

Actual Waveforms of Fixed Duration / Fixed Frequency Pulses

Total Current for Each Pulse is Identical

CONTROL OF LIGHT INTENSITY USING PULSES OF A FIXED DURATION AND FREQUENCY

TECHNICAL FIELD

The following description relates generally to control of light intensity, and in particular to light intensity control using pulses of fixed duration and frequency.

BACKGROUND

The control of the intensity of light is one factor considered in the design of displays and lighting. Errors in the control of light intensity may result in visual defects noticeable to a viewer (e.g., an off color pixel that occurs in an image area of even color and brightness). A number of methods of controlling the light intensity that are subject to such errors are described below. These methods fall generally into two types: pulse width modulation (PWM) and variable pulse frequency.

PWM, also referred to as a pulsed duty cycle, generally requires that the width or duration of a pulse is varied in length to control the current supplied to a light source. Typically, the longer the pulse duration, the longer the current flows through the light source. According to this method, the associated electronic circuitry changes the rise and/or the fall times of the pulse to accomplish the variation in pulse length. One disadvantage of PWM is that the total flow of current is not entirely a function of pulse length. Capacitance and inductance of the circuit controlling the light source affect the flow of current for the duration of the pulse length. In addition, this effect is not a constant value but varies at each discrete moment of time during the pulse. As a result, a pulse of twice the duration in length of a first pulse does not have twice the total current flow of the first pulse.

In another method, the frequency of the pulse within a time period may be varied to control the current supplied to a light source. Generally, increasing the frequency of pulses within the time period produces more total current resulting in greater brightness or intensity of the light source. Reducing the frequency of pulses within the time period produces less total current resulting in reduced brightness or intensity of the light source. Frequency generation is commonly achieved using a voltage controlled oscillator (VCO). In one example, a voltage reference across a capacitor may be varied to control the frequency output by an oscillator. The resultant frequency provided from the VCO is used to produce pulses that allow current to flow through the light source. A drawback of this method is that the analog circuitry used to create the voltage reference reduces the overall accuracy and preciseness of timing. However, even when frequency variation is generated using a digital source, a precise frequency may not be achieved because frequency generation is a reciprocal of time, and the reciprocal of any prime number is not evenly divisible over a period of time.

SUMMARY

In one general aspect, a device includes a first power potential; a second power potential; light source; and a current switch connected to the light source including an input to receive a current switch control signal to place the switch in one of an ON state and an OFF state including a timing cycle with a series of pulses of fixed duration and fixed frequency within the timing cycle to cause current to flow from the first potential to the second potential through the light source during the ON state to cause the light source to emit light of a desired intensity over the timing cycle. In one example, the light source may be implemented using a light emitting diode or an array of light emitting diodes.

The length of the timing cycle may be constant and the intensity of the light source may be varied by changing the number of pulses from one timing cycle to another timing cycle. The duration of each pulse of the current switch control signal may be equal to the period of time between pulses in the timing cycle. In addition, the duration of each pulse of the current switch control signal may be less than or equal to the period of time between pulses in the timing cycle.

The device may have an initial condition before flow of current through the current switch and the period time between pulses of the timing cycle is longer than the period of time for the circuit to return to the initial condition after a pulse of the timing cycle.

The number of pulses in a timing cycle may vary from zero to a maximum number corresponding to an intensity level of the light source from zero to a maximum intensity.

The persistence of human vision views the intensity of the light source as increasing with the increasing total current flow through the light source between timing cycles of the control signal without perceiving any visible defects from the light source. In addition, the device also may include a processing device to generate the current switch control signal supplied to the current switch and to time the start and end of each pulse within the timing cycle.

In another general aspect, a light source intensity control method to control the intensity of a light source includes providing a timing cycle; determining a desired intensity the light source; generating a control signal including a series of pulses of fixed duration and fixed frequency within the timing cycle corresponding to the desired intensity; and supplying control signal to an input of a current switch connected to the light source to place the switch in one of an ON state during each pulse and an OFF state after each pulse to cause current to flow from a first potential to a second potential through the light source during the ON state and cause the light source to emit light of the desired intensity over the timing cycle. The light source may be a light emitting diode or an array of light emitting diodes. The method also may include establishing a timing cycle of a constant length and the intensity of the light source is varied by changing the number of generated pulses from one timing cycle to another timing cycle. The duration of each pulse of the control signal may be equal to the period of time between pulses in the timing cycle. The duration of each pulse of the control signal also may be less than or equal to the period of time between pulses in the timing cycle.

A circuit that includes the light source may have an initial condition before flow of current through the current switch and the period time between pulses of the timing cycle is longer than the period of time for the circuit to return to the initial condition after a pulse of the timing cycle.

The number of pulses in a timing cycle may vary from zero to a maximum number corresponding to an intensity level of the light source from zero to a maximum intensity. In addition, the persistence of human vision views the intensity of the light source as increasing with the increasing total current flow through the light source between timing cycles of the control signal without perceiving any visible defects from the light source.

Other features will be apparent from the description, the drawings, and the claims.

DESCRIPTION OF DRAWINGS

Like reference symbols in the various drawings indicate like elements.

DETAILED DESCRIPTION

A method to control the intensity of lights, illumination fixtures, and displays using pulses of a fixed duration and a fixed frequency (FD/FF) is described in detail below. In particular, the method may be used to control one more light sources. By varying the number of pulses in a control burst as described below, the total current flowing through the light source may be precisely controlled providing greater accuracy than other methods, such as, for example, PWM or variable pulse frequency. The FD/FF technique may be used in conjunction with any number of light sources, and finds particular application in LED displays and for any type of LED illumination fixture.

Figure 1:
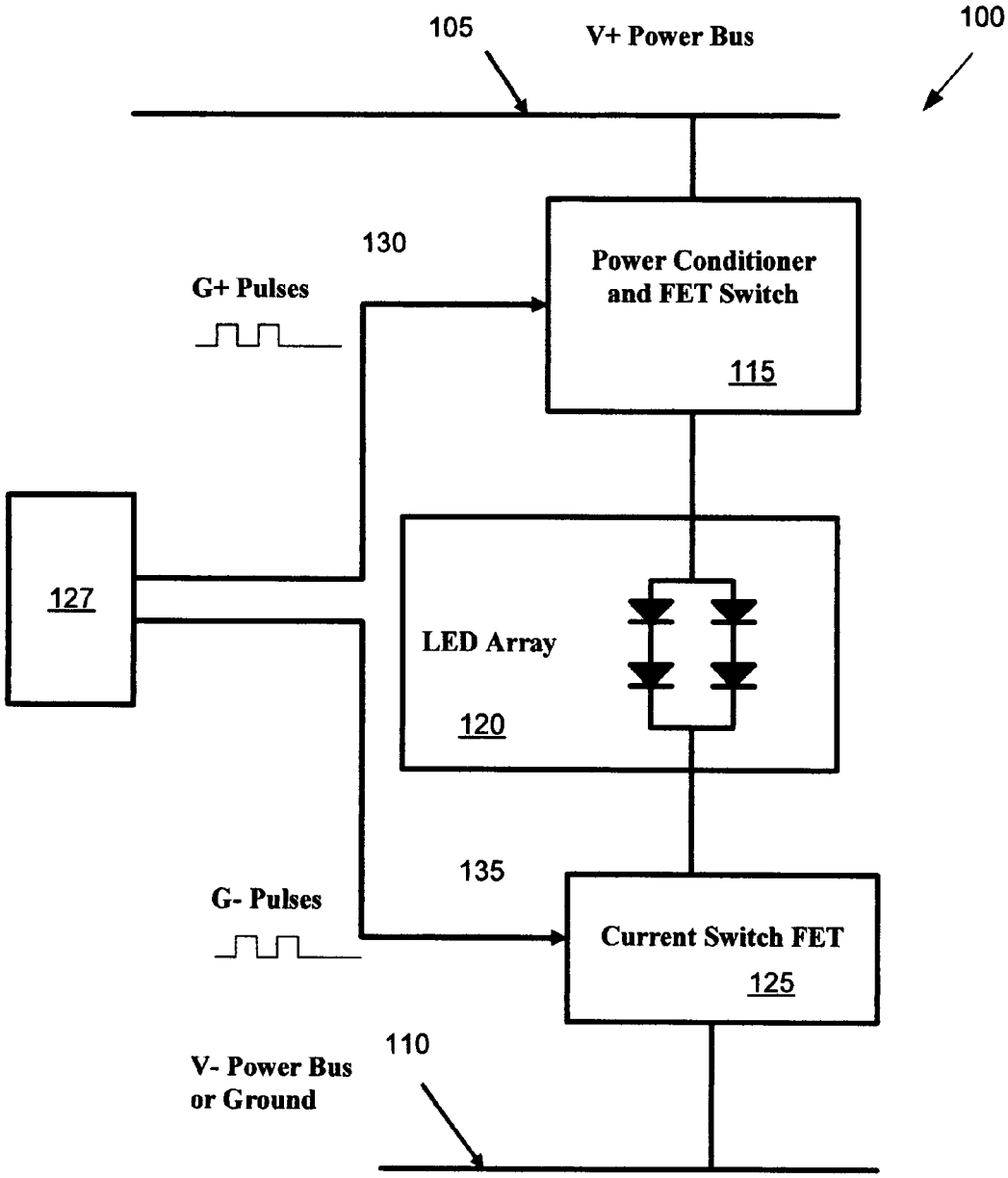
FIG. 1 is an exemplary block diagram for a circuit for intensity control of a light source.

FIG. 1 shows one example of a light system 100 that may be used to illustrate a control process for controlling the desired intensity emitted by a light source, such as, for example, LEDs. The system 100 may include a first power potential 105, a second power potential 110, a power conditioner 115, a light source 120, a current switch 125, and a processing device 127. The first potential 105 may be implemented as a power bus or positive voltage side. The second potential 110 may be a power return, a sink, or a ground. Although FIG. 1 shows use of a positive power rail, it will be appreciated that a negative power rail also may be used.

The power conditioner 115 stabilizes fluctuations on the power bus and may include an input 130. In one example, the power conditioner 115 may be implemented using a switch, for example, a transistor, such as a field effect transistor (FET). The power conditioner 115 may be switched on and off, for example, by applying a control signal of pulses to input 130 to address a particular light source or set of light sources that are switched on simultaneously. The control signal may be supplied by processor to control the gate of the FET to allow current to pass through the power conditioner.

The light source 120 may be implemented by any configuration of LEDs to provide illumination or a display. In the example shown in FIG. 1, the light source 129 is implemented using an array of four LEDs arranged in a 2×2 matrix. Although FIG. 1 shows four LEDs in a 2×2 matrix, one skilled in the art will appreciate that other configurations are possible, including a single LED, multiple LEDS, or matrixes of any number of LEDs (e.g., as a particular application requires). The array may be a pixel in a display screen.

The light source 120 is connected to the second potential by the current switch 125. The current switch 125 determines when the electrical current flows through the light source 120 or in this case the LED array. The current switch 125 includes an input for a control signal 135 that may be used to trigger an ON or an OFF state of the current switch 125. When the control signal 135 triggers an ON state, current flows from the light source 120 to the second potential 110.

Using this arrangement, the current passing through the LED array is precisely controlled to determine an intensity emitted by the light source. By providing a control signal of FD/FF, a linear relationship of a specified intensity level verses total current through the LED array per time period may be achieved. For example, using the FD/FF control method, specifying an intensity level 177, the current is substantially 177 times greater than the current supplied for a specified intensity of level 1.

As shown in FIG. 1, the power bus 105 for the LED array may have variations in, for example, one or more of the voltage level, the source resistance, and electronics noise. Therefore, power supplied to the light source 120 may be routed through an optional power conditioner 115 to ensure that the voltage and source impedance applied to the LED array are consistent. The power conditioner 115 provides consistency by forcing the initial conditions of the LED array to be identical before the control signal turns on the current switch 125 as described bellow. The power conditioner 115 is controlled by the input 130. The input 130 supplies a series of gate pulses G+ to the power conditioner 115. In this example, the gate pulses G+ connect the anodes of the LED array to the power bus 105. For example, when the input signal G+ is in a high state, the anodes of the LED array are connected; when the input signal G+ is in a low state, the power is disconnected. As mentioned above, the input signal G+ also provides the capability to digitally address or select the LED array of the light source 120. This may be useful, for example, when controlling a number of arrays of LEDs that make up a display or an illumination device. Further description of the power conditioner is described in concurrently filed U.S. patent application Ser. No. 11/882,322 filed on Jul. 31, 2007, titled "Power Line Preconditioner for improved LED intensity control" which is hereby incorporated by reference in its entirety for all purposes.

The current switch 125 switches the current through the LED array in two states: ON and OFF. The current switch 125 is controlled by the input 135. A series of gate pulses G− is supplied to the input 135 to control the switch between the ON and OFF states. When the control pulse G− is high, the current switch 125 is turned on and current flows through the current switch 125 to the ground 110; when the control pulse G− is low, the current switch 125 is turned off and current ceases to flow. If a power conditioner 115 is used in the circuit 100, the timing and duration of the control pulse G− correlates with the control pulse G+. For example, the control pulse G+has a longer duration than G− and G− is timed to pulse high after G+ pulses high and is time to pulse low before G+ pulses low. By applying a desired control pulse G− pattern, a desired electrical current flow through the light source 120 may be achieved, as described in detail below.

The processing device 127 may be implemented using, for example, a processor, an ASIC, a digital signal processor, a microcomputer, a central processing unit, a programmable logic/gate array to generate, among other things, the control signals G− and G+. The processing device 127 also may include associated memory. The processing device 127 may implement a digital counter to generate pulses of a particular duration and timing on inputs 130 and 135 to control the intensity of the light emitted by the source 120 as described below.

Figure 2:
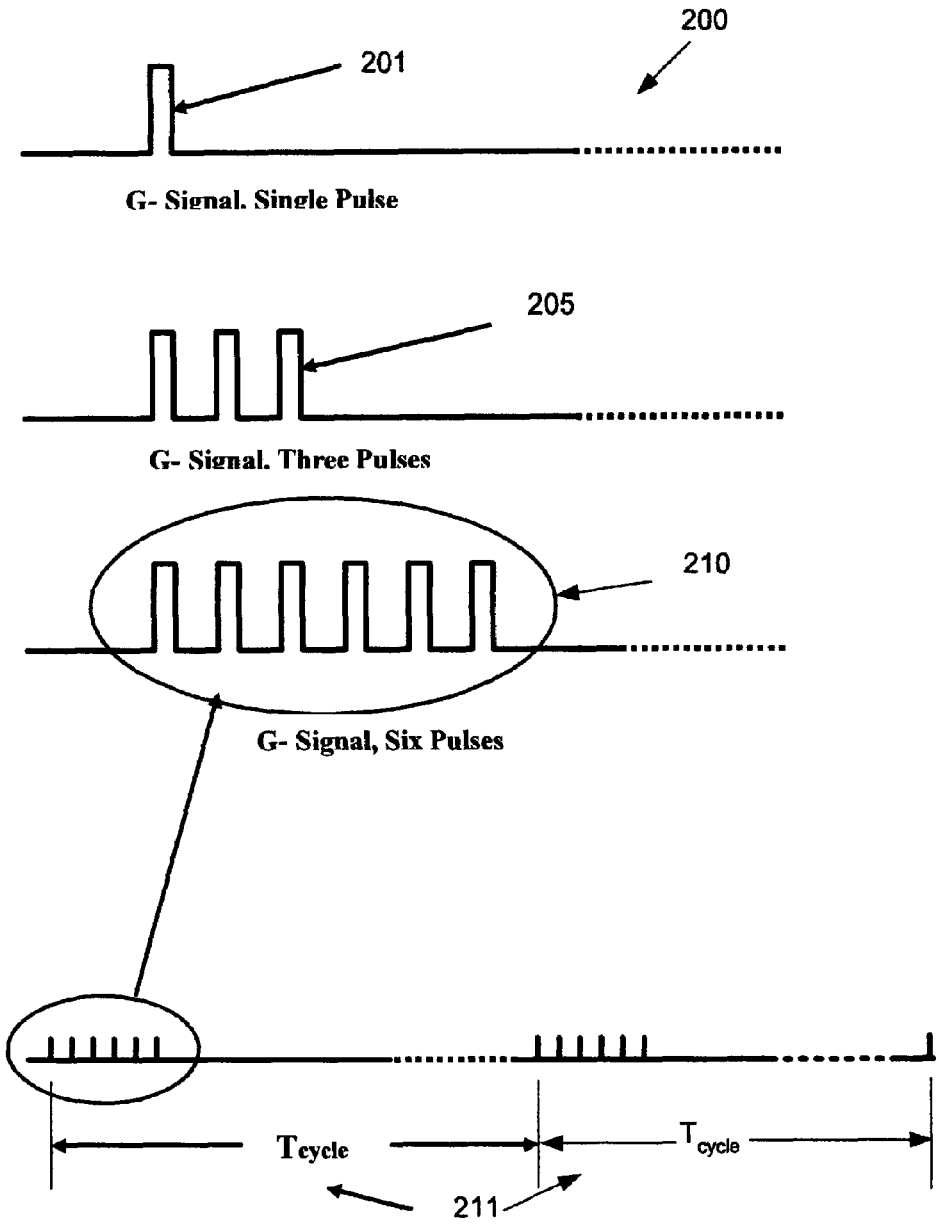
FIG. 2 illustrates a Fixed Duration/Fixed Frequency control signal showing bursts of pulses within a fixed time cycle for use in the circuit of FIG. 1.

The FD/FF control technique provides precision in the control of the light system 100. For example, if one pulse provides a total amount of current flow, then three such pulses provides three times as much total current flow. FIG. 2 shows a comparison 200 of a burst of pulses 201, 205, 210 for a pulse stream over a timing period Tcycle 211. As illustrated in FIG. 2, an example of a single pulse 201 of a fixed duration is shown. The duration may be consistently reproduced by the control signal output from the processing device 127, such as, for example, a processor or microcomputer output to control the high and low states of the control signal G− input to the current switch 125. The duration of each pulse is fixed. The length of time between pulses also is fixed and may be selected to be longer than the time necessary for the circuit to settle to the same initial condition before each new pulse. For example, a microcomputer may provide ON pulses having a duration of 100 nS, and provide an OFF time between pulses of a duration of 200 nS. Therefore, the total ON and OFF pulse cycle for the signal has a duration of 300 nS. The 100 nS and 200 nS and 300 nS time periods are consistent from pulse to pulse and from timing period 211 to timing period 211. In other words, the duration of each pulse is fixed and frequency between each pulse if fixed during a timing period with the number of pulses varying within a timing period according to a desired intensity of light.

FIG. 2 also shows a series of three pulses 205 driven by the same output (e.g., a microcomputer). In addition, FIG. 2 shows an example of a series of six pulses 210. By comparing the pulses, one can see that the frequency of the pulses is constant, that is the time between the pulses is constant. Of course the pulses shown are just a few examples, and a string of pulses may be of any number of different lengths, for example, 255 or 500 pulses long. As an example, a pulse string of 500 pulses in a 300 nS cycle time are 500×300 nS=150 uS. As a result, a burst period (i.e., a Tcycle) of control pulses as low as 150 uS (or less than ⅙ millisecond) is achieved for a light system providing 500 intensity levels. The control pulses are faster than required for the persistence of the human eye to see a continuous light from the LED array (e.g., around 30 milliseconds). Even if the control pulse is 10 times as long, the control pulse is many times faster than the persistence of the human eye. The burst period or timing cycle 211, Tcycle, also is kept at a fixed duration, no matter the specified intensity level. If the intensity level is specified as zero, then there are no ON pulses in that specific burst or Tcycle.

As shown in FIG. 2, the G− control signal input to the current switch 125 (e.g., a signal applied to the gate terminal of an FET) is used to control the ON and OFF state of the current switch 125. During a pulse of the control signal, current flows through the current switch 125 and therefore through the light source 120 (e.g., the LED array). The intensity of the LEDs as perceived by a viewer is proportional to the total current flow through the LED array. By providing three identical pulses of the same pulse cycle as the single pulse, the total current flow through the LED array is increased to substantially three times the total current of the single pulse. Similarly, a string of six identical pulses of the same pulse cycle provides six times the total current as the single pulse of the same duration. By providing many more pulse cycles, for example, 255 pulses of the same pulse cycle as the single pulse, the total current can be increased by substantially 255 times the total current of the single pulse cycle. As a result, the control of total current achieved using the FD/FF control signal may be considered digitally accurate and digitally precise. Since the timing cycle is relatively short (e.g., less than a millisecond as shown in FIG. 2), the persistence of human vision views the intensity of the LEDs as increasing with the increasing total current flow between timing cycles without perceiving any visible defects, such as, for example, stepping or flicker.

Figure 3:
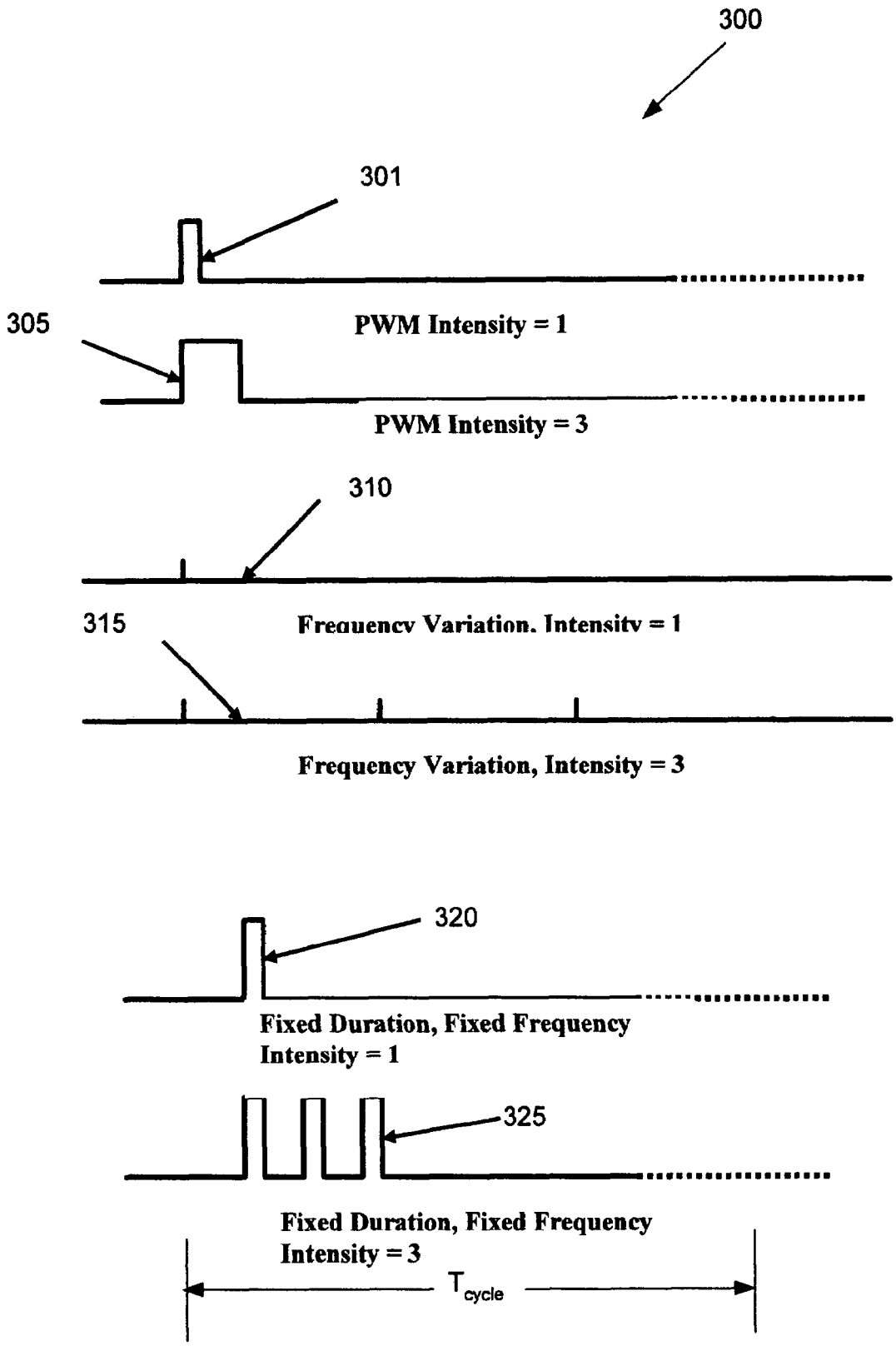
FIG. 3 shows a comparison between the Fixed Duration/Fixed Frequency signals and PWM and variable frequency signals.

FIG. 3 illustrates a comparison 300 of the FD/FF control in relation to two other pulse control methods over a timing cycle. As shown in FIG. 3, the pulse signal for an intensity level of one using a PWM control scheme is shown as a single pulse 301 of a first duration that is used to induce a total current flow of X during the duty cycle of the PWM signal. FIG. 3 also shows a pulse signal 305 for an intensity level of three using the PWM method having a duration or pulse width that is three times the length of the pulse signal for an intensity level one. By lengthening the pulse, the signal attempts to induce a total current flow that is three times the total current (i.e., 3×) of the pulse of the first duration. However, as explained below, this signal does not provide 3× current.

FIG. 3 also shows a series of pulses implemented using a variable frequency control method. FIG. 3 shows a first control signal 310 having a single pulse generated for a desired intensity level of one. A second control signal 315 has a series of three pulses during the same timing period for a desired intensity level of three that is three times the frequency of intensity level one. The desired response under this method is that three times the frequency of the single control pulse provides three times the total current to the light source (and therefore three times the intensity). However, if the frequency is generated by an analog oscillator, the accuracy of the signal may be poor. When the variable controlled frequency of the control signal is generated by a digital source, for example, a microcomputer, varying the frequency requires calculation of reciprocals since frequency is a reciprocal of time. As a result, the use of look up tables or complex computer calculations are need. In addition, as with any type of reciprocal operation, the results are not precise because the desired intensity level of any of the prime numbers does not divide evenly. Because of this use of a variable frequency control signal in a digital environment works against itself.

FIG. 3 also shows two control pulses 320 and 325 generated using a FD/FF control technique for intensity levels of one and three, respectively. Generation of this pulse pattern results in a precision in current control that is not achieved in the other two methods described above. Using an FD/FF control signal, the intensity levels are determined by a processor setting a pulse counter to provide the pulses for a desired intensity within a timing cycle. As a result, the signals are digitally precise since no reciprocals are involved.

Figure 4:
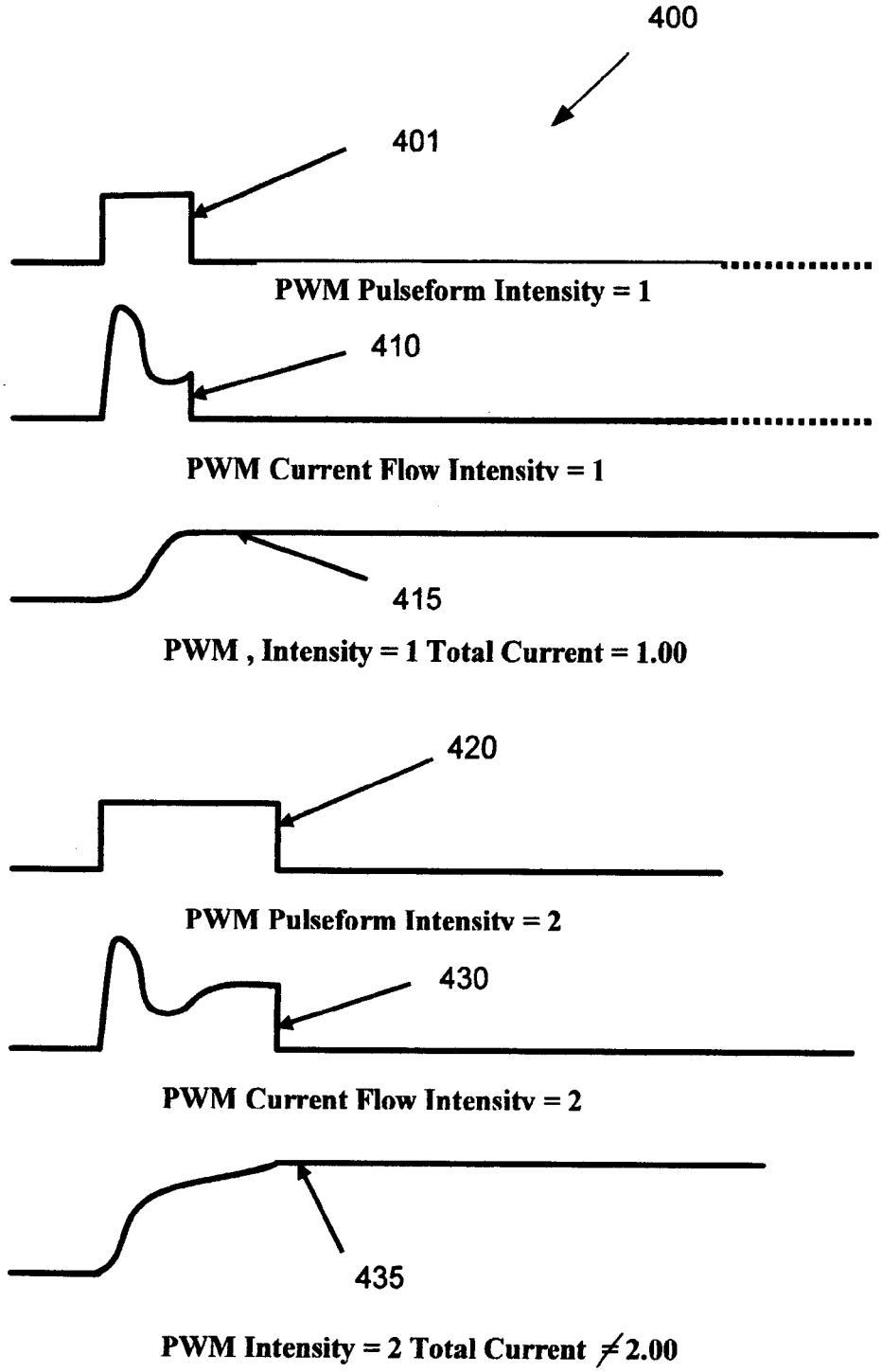
FIG. 4 illustrates distortions associated with the effects of implemented PWM control signals in an exemplary circuit.

FIG. 4 illustrates inaccuracies 400 associated with PWM control signals. Pulse 401 is an example of a PWM control signal for a desired intensity level of one. A desired result of the control pulse is to generate a square wave of current flow (i.e., even current flow) through the LED array. However, because of inductive and capacitive effects of the power lines and circuit elements, the actual current flowing through the LED array may be represented as the wave pattern 410, shown in FIG. 4. When the current is initially turned on, there is a delay as the induction of the electronic path through the power lines, LED array, and current switch causes a ramp up of current flow. In addition, because the power line source is initially unloaded, it is at its highest value. This results in an excess of current flow as the inherent capacitance of the circuitry discharges. The current flow then experiences some ringing before the current wave settles to a constant level. As can be seen in FIG. 4, the total current flow 415 is distorted. Ideally, the total current should be a straight line of constant slope. Instead, the resultant total current flow 415 is curved, as shown in FIG. 4.

In addition, it will be appreciated that FIG. 4 has been simplified for illustrative purposes to show the pulse distortion roughly equal to one pulse length. However, in typical implementations, induction and capacitance of an LED array produces ringing and overshoot signals for several microseconds (e.g., 20 to 50 microseconds typical). Therefore, the actual distortion effects may last for several times the length of an intensity level one pulse (e.g., as shown below in FIG. 6).

FIG. 4 also shows a PWM control pulse 420 for a desired intensity level of two. The pulse 420 is shown as twice the length of the intensity level one pulse 401. The resultant current flow for the longer pulse 420 is shown as wave 430. Looking at FIG. 4, one can see the current flow is shown as settling to a constant current at the latter portion of this waveform. However, the current flow of last half of the waveform is not the same as the current flow for the first half of the waveform. As a result, the total current flow 435 is not equal to twice the total current flow of the intensity level one pulse 401. In other words, the total current flow for a desired intensity level two is not twice the total current flow for a desired intensity level 1 using PWM control signals. Note that the wave distortion, as shown here as the length of a selected intensity level of one, is in fact much longer than that shown, so that the distortion effect is actually worse.

Figure 5:
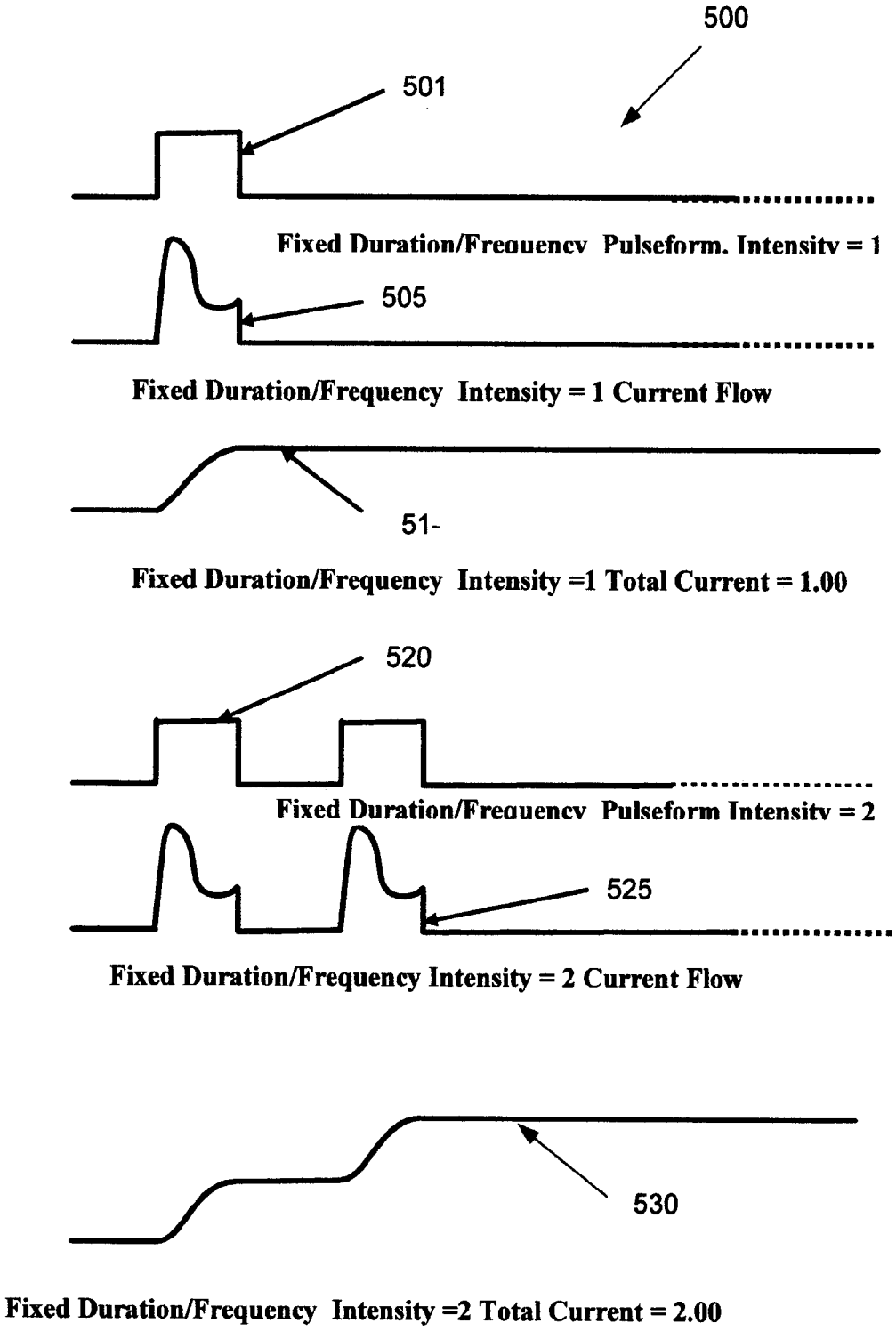
FIG. 5 shows exemplary pulse forms for Fixed/Duration/Fixed Frequency control pulses.

FIG. 5 provides an illustration 500 of FD/FF control signals and their relation to current flow. FD/FF does not suffer from the effects of distortion in the way associated with PWM control signals as explained below. For example, FIG. 5 shows a pulse 501 for FD/FF control signal for a desired intensity level one. The current flow through the LED array resulting from the intensity level one pulse is shown as a waveform 505. The total current flow 510 for the FD/FF control method also is shown. As can be seen, these graphs are similar to those produced using PWM for the first desired intensity level.

FIG. 5 shows that for a desired intensity level of two, the FD/FF technique provides two pulses 520 of fixed duration and frequency. In contrast to PWM, instead of extending the duration of a single pulse, the FD/FF technique returns the control line to an OFF condition after one pulse period for a fixed period of time. The OFF period restores the electronic circuitry back to the initial conditions. As a result, the second generated pulse of the same duration provides a substantially identical current flow as that of the initial pulse. As can be seen in FIG. 5, the current flow 525 for the second pulse is substantially similar to that of the first pulse. As a result, regardless of the inherent distortion due to inductive and capacitive effects of the circuit, the total current for two pulses is generally or substantially twice the total current flow of the single pulse. For example, if the intensity level one total current flow has a reference value of 1.00, then the total current flow 530 for the intensity level two has a value of substantially 2.00. Extrapolating one can see, for example, that for a desired light intensity level of 177, the total current is 177.00.

Figure 6:
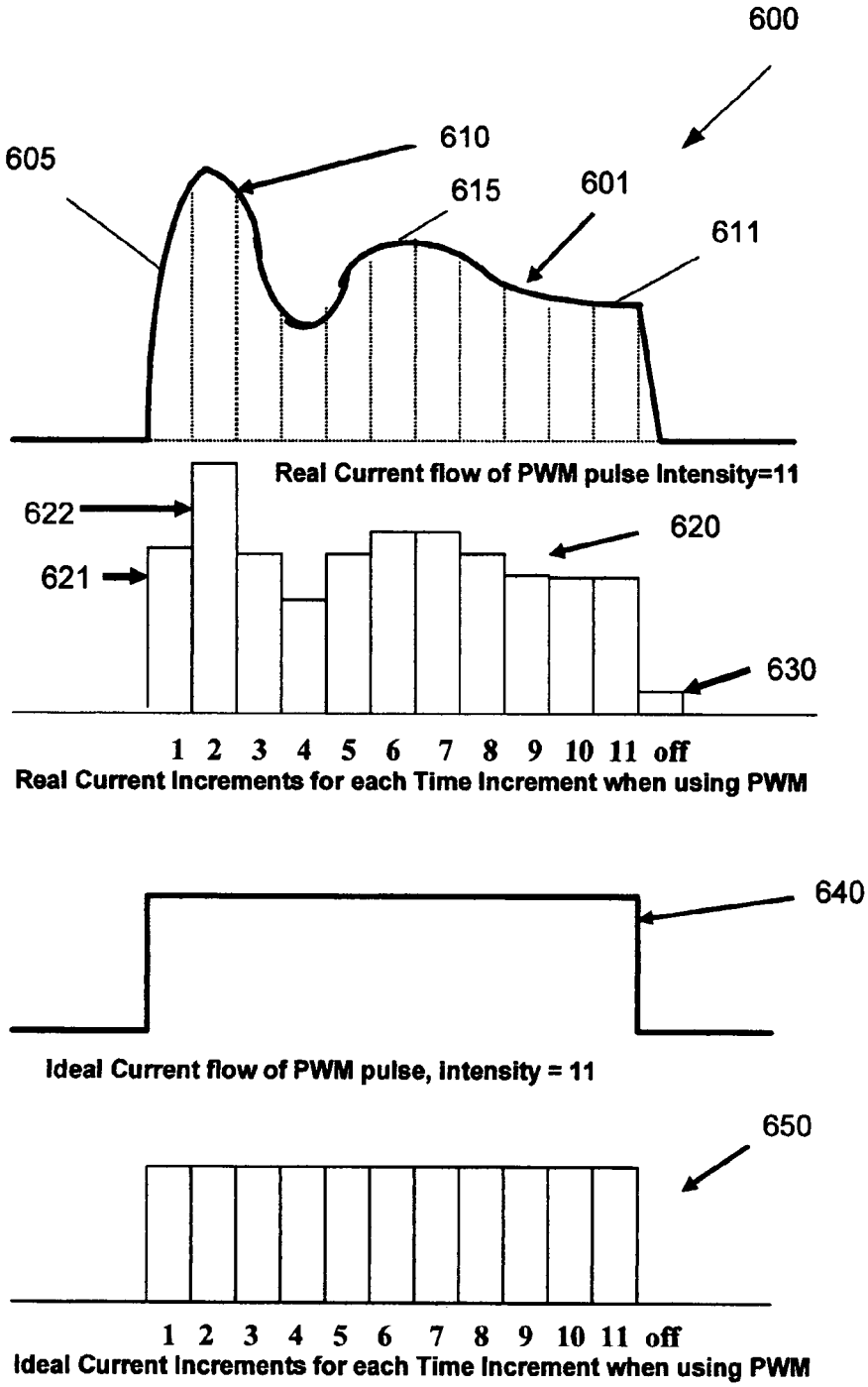
FIG. 6 illustrates a non-linear characteristic of PWM control signals.

FIG. 6 provides an illustration 600 of current flow distortion using PWM pulses that are about the same length of time as the settling time for the overshoot and ringing of the current flow. However, in typical applications current control may be much worse using PWM control signals. In typical applications, current flow overshoot and ringing may last on the order of over 50 microseconds. The PWM increments using conventional state of the art CPU signals are on the order of hundreds of nanoseconds. Therefore, the PWM pulse increments are on the order of one tenth (1/10) to one hundredth (1/100) times the length of the current flow settling time. FIG. 6 attempts to shows this in scale. For example, the PWM length for an intensity level of eleven 601 is shown. In this example, a PWM control pulse of length eleven is sent to control a current switch. Approximating actual current flow through the light source using PWM, the current is shown having a sloped rise time 605 due to the inductance of the current flow path, followed by an overshoot 610 as the same inductance and stray circuit capacitance prevents the current flow increase from settling. After a number of cycles; the current flow settles to a steady state 611 after some ringing 615. Therefore, the ideal current flow (where the current flow goes from zero to optimum level instantly and turns off instantly) is impossible due to actual circuit conditions of stray capacitance and path inductance.

During each of the PWM time increment periods (1-11), the total current flow of that time period differs from the total current flow for other time periods. As a result, if an intensity of one is desired, the total current flow for the corresponding PWM signal is shown as the area of the boxes in graph 620. If an intensity level of two is desired, the total current flow for the corresponding PWM control pulse is the sum of the boxes 621 and 622. However, the area of both boxes 621 and 622 and is not twice the area of the box 621. Similarly, as the desired intensity rises through time increments 3 to 11 for this example, the increase in total current (i.e., the sum of the area of the boxes) does not increase in a linear fashion. Thus, when using PWM current control methods, the actual LED intensity versus any specified intensity level is not a linear function (i.e., a straight line). There also is a delay when the PWM pulses turns off the current flow as box 630 further adding to the non linearity of the PWM method.

Comparing the real life waveform 605 to the idealized waveform 640, and the corresponding real life flow of current 621, 622, an so on, to the idealized current 650, and one can appreciate that the comparison shows that the real life waveforms are nonlinear, thus exposing an inherent flaw of PWM control of lighting systems. In contrast, by using the FD/FF control signals any of the nonlinear effects may be considered inconsequential because every pulse is identical, or substantially identical, to every other pulse. By returning the electronic conditions to the initial state between pulses, all overshoot, ringing, and delayed turn off effects are the same for each pulse. As a result, the flow of current is substantially the same for each pulse. Therefore, the desired intensity of the light source is a linear function in relation to the actual total current flow. This is illustrated in FIG. 7.

Figure 7:
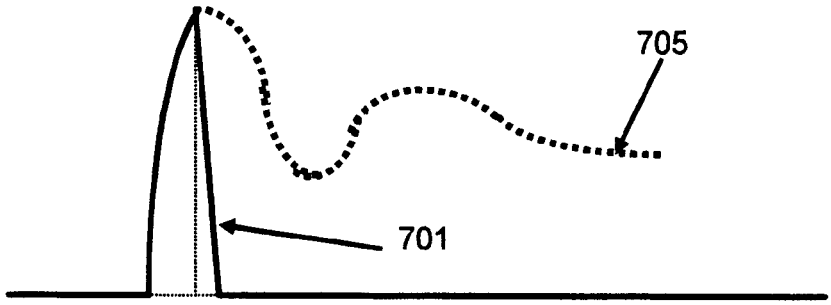
FIG. 7 illustrates a linear characteristic of Fixed Duration/Fixed Frequency control signals.
Figure 7:
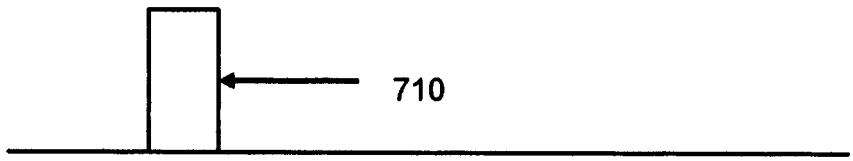
Figure 7:
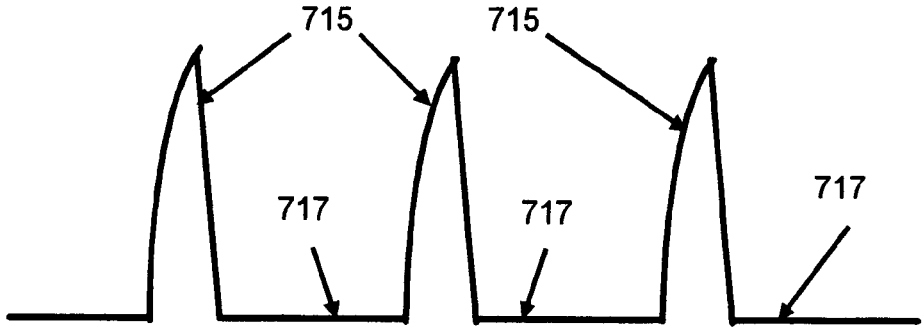
Figure 7:
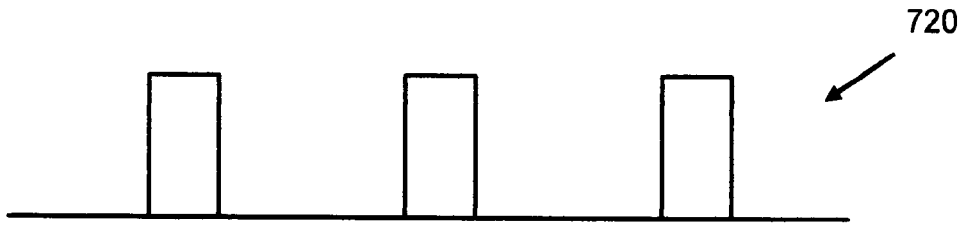

FIG. 7 shows a distorted waveform 701 similar to the waveform of FIG. 6 which is expected when the LED current is suddenly turned on. The inductive and capacitive effect of the circuit causes the distortion as explained above which is the result of the fact that in actual implementations there is not an infinitely fast rise and fall time associated with a pulse. As will be appreciated, the components of the associated circuit have an inductance, capacitance, and resistance, which causes the overshoot and ringing shape of the waveform as explained below with respect to FIG. 8. However, in the FD/FF control signals, the waveform is cut short into a Fixed Period segment. As a result, the rest of the waveform (e.g., associated with the continuing PWM waveform) never occurs as indicated by the dotted line 705. The fixed duration pulse results in a total current flow 710 as shown in FIG. 7. The exact value of the total current for any individual pulse duration is irrelevant because the FD/FF technique uses pulses having the same waveform. For example, if the total current flow for one pulse has a value of 1.000. In order to increase the intensity of the LEDs, the pulse may be repeated 715, as shown in FIG. 7. However, between the pulses 717, the conditions of the circuit are allowed to settle back to the initial conditions. When multiple pulses are used in the FD/FF, each of the resulting pulses is substantially identical. Each of the total incremental current boxes 720 also is identical. Therefore, the total current for three pulses is three times the total current for one pulse, or a value of 3.000. Similarly, the total current for 235 pulses is 235.000.

Figure 8:
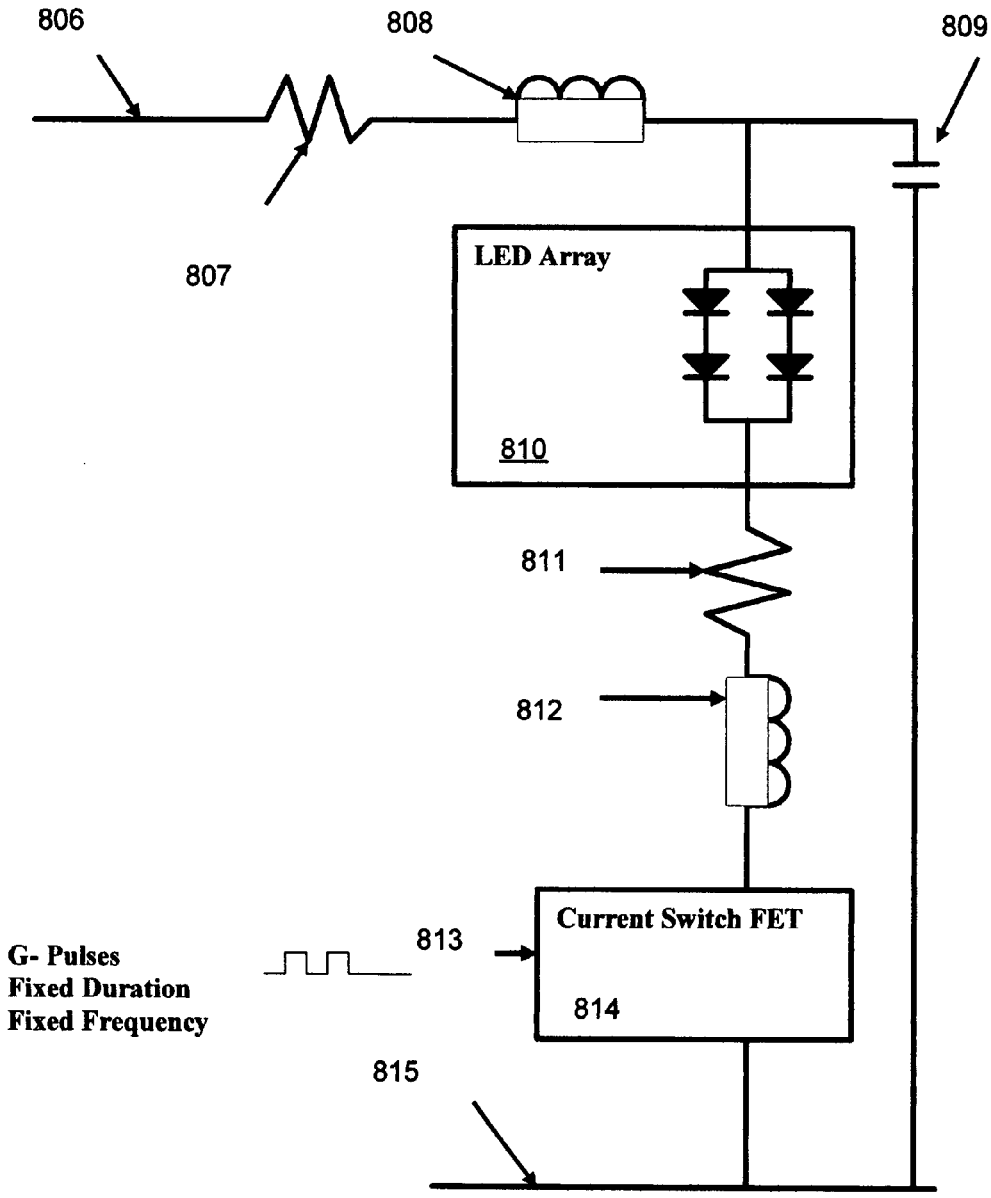
FIG. 8 is an exemplary block diagram of the electronic equivalence circuit of the LED array and current switch.

FIG. 8 shows the electronic equivalence circuit 800 for the LED array and current switch shown in FIG. 1. The impedance from the power line side is represented by resistor 807 and capacitor 809 and inductor 808. The power line 105 is connected and disconnected to the anode side of the LEDs of light source 120 by the preconditioner 115. The impedance of the path through the LED array and current switch 125 is represented by resistor 811 and inductor 812. When the current switch 125 and preconditioner 115 are initially turned to the ON condition, the stored power in capacitor 809 discharges through the preconditioner 115 the Led array of the light source 120 the current switch 125 the resistance 811, and the inductor 812. This current saturates the inductor 812 in the form of a magnetic field, and when capacitor 809 is discharged, this stored magnetic field collapses to cause the overshoot condition shown in FIGS. 6 and 7. This combination of stray capacitance and inductance forms a tuned circuit, which is dampened by the resistance 811. Since resistance 811 is a very low value, typically tens of ohms, the Q factor of this tuned circuit is significantly large, and the ringing condition which follows the overshoot, as shown in FIGS. 6 and 7, can go through several cycles. When the current switch 125 and the preconditioner 115 are turned to the OFF condition, the tuned circuit is dampened by the resistance 811 in series with the OFF resistance of the switches 115 and 125, typically millions of ohms. This means that the Q factor of the circuit in the OFF state is very low, and the system returns to the initial conditions fairly quickly, many orders of magnitude faster than the transition to the ON condition. Thus, the FD/FF method re-establishes the initial conditions fairly quickly, in preparation for the following pulse. As a result, linear precision is achievable using FD/FF control signal regardless of the actual circuit conditions.

Figure 9:
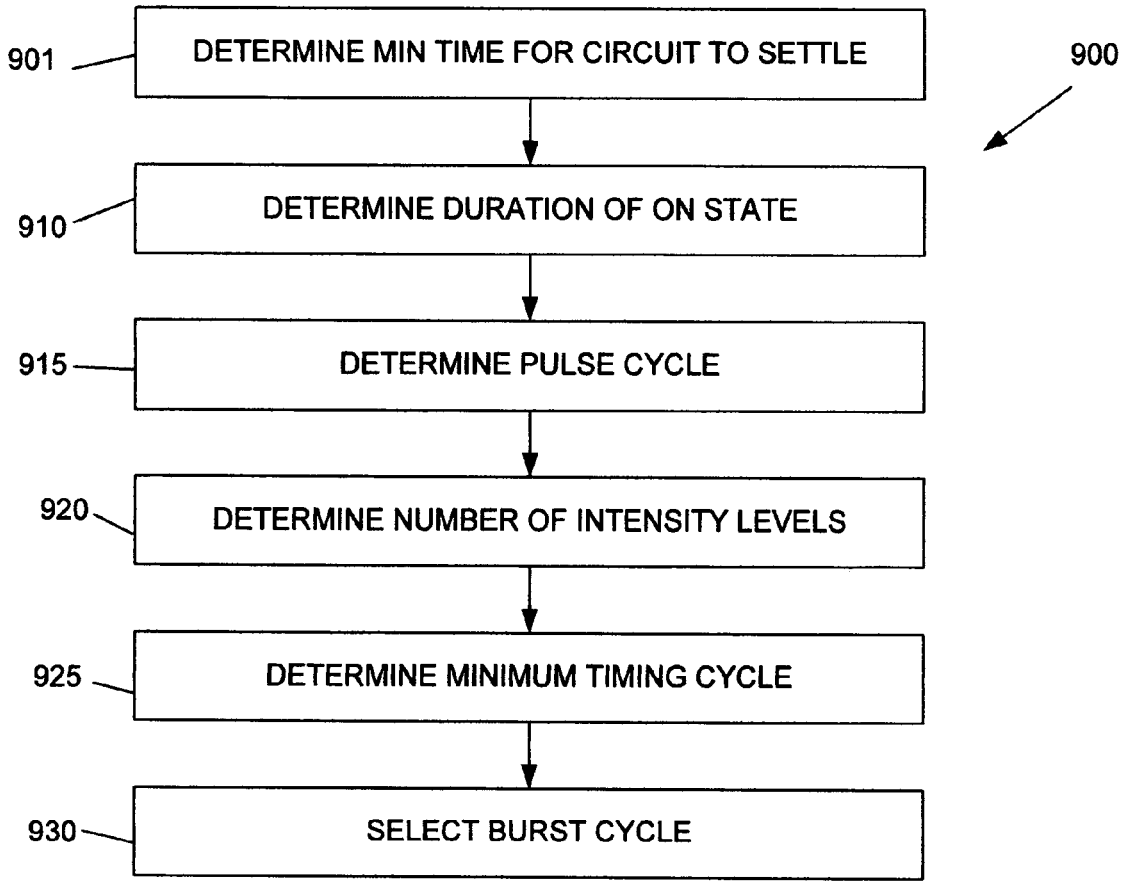
FIG. 9 is an exemplary flow chart for providing a burst cycle for a light source.

FIG. 9 is an exemplary flow chart 900 to select a burst cycle of a particular circuit for a light source. The burst cycle is typically selected or determined during circuit design or implementation of prototypes. As shown in FIG. 9, the impedance, inductance, and capacitance during circuit operation during the ON state and the Off state may be accounted for to determine the minimum time necessary for the circuit to return to initial conditions before entering ON state 901. The duration of the pulse for the ON state may be determined 910. The pulse cycle may be determined to be the determined minimum time for the circuited return to initial condition added to the duration of the pulse 915. The number of desired intensity values for the light source also may be selected 920. The minimum timing cycle may be determined by multiplying the number of intensity values by the pulse cycle 925. The actual timing or burst cycle may be selected to be greater than or equal to the determined minimum cycle 930. Of course, one will appreciate that other steps or order of steps also may be used, such as, for example, starting with a timing cycle length and selecting a desired number of intensity values, dividing the timing cycle by the number of intensity values to determine a pulse cycle length. The minimum time necessary for the circuit to return to initial conditions may be subtracted from the determined pulse cycle to determine the pulse duration of the control signal. Once timing is determined, the intensity of the light source may be controlled as described below in FIG. 10.

Figure 10:
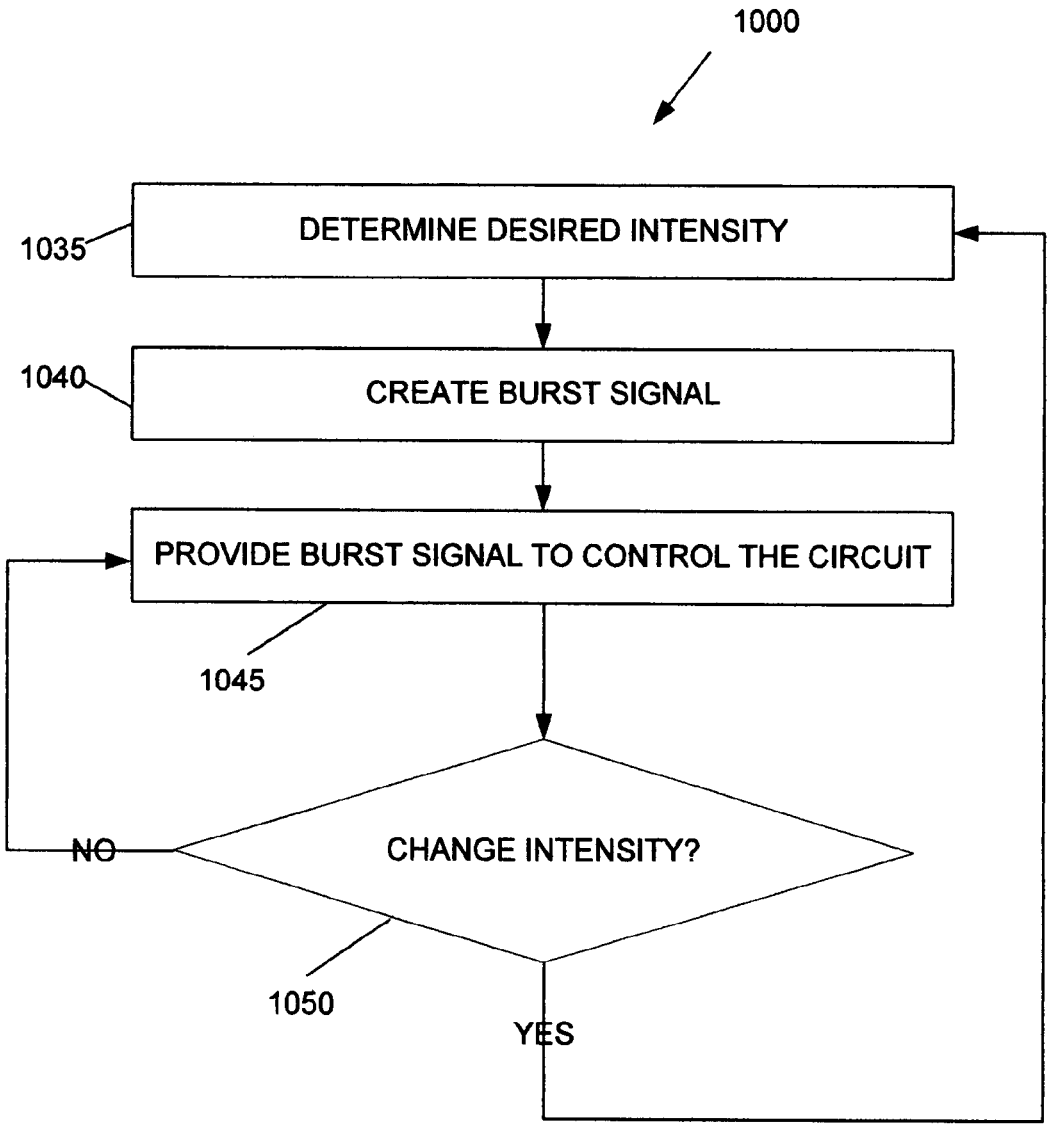
FIG. 10 is an exemplary flow chart for controlling the intensity of a light source with a Fixed Duration/Fixed Frequency control signal.

FIG. 10 shows an exemplary flowchart 1000 to control the intensity of the light source. As shown, the intensity of the light source may be controlled by determining the desired intensity 1035. A control or burst signal G− is generated with a series of pulse cycles equal to the desired intensity 1040, for example, as described above. If a preconditioner is used, the control pulse G+ also may be generated to correspond with the timing of the burst signal G−, as described above. The control signal is provided to input of a current switch to control the follow of current through the light source by opening and closing the current switch according to the control thereby causing the light source to illuminate with the desired intensity 1045. As long as the desired intensity remains the same, the control signal is provided to the light source. If a change intensity is desired 1050, a new intensity is determined 1035 and the process is repeated.

An LED system is one type of light source described above. As used herein, "light source" should be understood to include all sources capable of radiating or emitting light, including: incandescent sources, such as filament lamps, and photo-luminescent sources, such as gaseous discharges, fluorescent sources, phosphorescence sources, lasers, electro-luminescent sources, such as electroluminescent lamps, light emitting diodes, and cathode luminescent sources using electronic satiation, as well as miscellaneous luminescent sources including galvano-luminescent sources, crystallo-luminescent sources, kine-luminescent sources, thermo-luminescent sources, triboluminescent sources, sonoluminescent sources, and radioluminescent sources.

A number of exemplary implementations and examples have been described. Nevertheless, it will be understood that various modifications may be made. For example, suitable results may be achieved if the steps of described techniques are performed in a different order and/or if components in a described system, architecture, device, or circuit are combined in a different manner and/or replaced or supplemented by other components. Accordingly, the above described examples and implementations are illustrative and other implementations not described are within the scope of the following claims.

What is claimed is:

1. A device comprising:

a first power potential;

a second power potential;

light source; and a current switch connected to the light source including an input to receive a current switch control signal to place the switch in one of an ON state and an OFF state including a timing cycle with a series of pulses of fixed duration and fixed frequency within the timing cycle to cause current to flow from the first potential to the second potential through the light source during the ON state to cause the light source to emit light of a desired intensity over the timing cycle.

2. The device of claim 1 wherein the light source is a light emitting diode.

3. The device of claim 1 wherein the light source is an array of light emitting diodes.

4. The device of claim 1 wherein the length of the timing cycle is constant and the intensity of the light source is varied by changing the number of pulses from one timing cycle to another timing cycle.

5. The device of claim 1 wherein the duration of each pulse of the current switch control signal is equal to the period of time between pulses in the timing cycle.

6. The device of claim 1 wherein the duration of each pulse of the current switch control signal is less than or equal to the period of time between pulses in the timing cycle.

7. The device of claim 1 wherein device has an initial condition before flow of current through the current switch and the period time between pulses of the timing cycle is longer than the period of time for the circuit to return to the initial condition after a pulse of the timing cycle.

8. The device of claim 1 wherein the number of pulses in a timing cycle varies from zero to a maximum number corresponding to an intensity level of the light source from zero to a maximum intensity.

9. The device of claim 1 wherein persistence of human vision views the intensity of the light source as increasing with the increasing total current flow through the light source between timing cycles of the control signal without perceiving any visible defects from the light source.

10. The device of claim 1 further comprising:

a processing device to generate the current switch control signal supplied to the current switch and to time the start and end of each pulse within the timing cycle.

11. A light source intensity control method to control the intensity of a light source, the method comprising:

providing a timing cycle;

determining a desired intensity the light source;

generating a control signal including a series of pulses of fixed duration and fixed frequency within the timing cycle corresponding to the desired intensity; and supplying control signal to an input of a current switch connected to the light source to place the switch in one of an ON state during each pulse and an OFF state after each pulse to cause current to flow from a first potential to a second potential through the light source during the ON state and cause the light source to emit light of the desired intensity over the timing cycle.

12. The method of claim 11 wherein light source is a light emitting diode.

13. The method of claim 11 wherein the light source is an array of light emitting diodes.

14. The method of claim 11 wherein establishing a timing cycle includes establishing a timing cycle of a constant length and the intensity of the light source is varied by changing the number of generated pulses from one timing cycle to another timing cycle.

15. The method of claim 11 wherein the duration of each pulse of the control signal is equal to the period of time between pulses in the timing cycle.

16. The method of claim 11 wherein the duration of each pulse of the control signal is less than or equal to the period of time between pulses in the timing cycle.

17. The method of claim 11 wherein a circuit including the light source has an initial condition before flow of current through the current switch and the period time between pulses of the timing cycle is longer than the period of time for the circuit to return to the initial condition after a pulse of the timing cycle.

18. The method of claim 11 wherein the number of pulses in a timing cycle varies from zero to a maximum number corresponding to an intensity level of the light source from zero to a maximum intensity.

19. The method of claim 11 wherein persistence of human vision views the intensity of the light source as increasing with the increasing total current flow through the light source between timing cycles of the control signal without perceiving any visible defects from the light source.

* * * * *

UNITED STATES PATENT AND TRADEMARK OFFICE

CERTIFICATE OF CORRECTION

PATENT NO. : 7,598,683 B1
APPLICATION NO. : 11/882323
DATED : October 6, 2009
INVENTOR(S) : Bassam D. Jalbout et al.

It is certified that error appears in the above-identified patent and that said Letters Patent is hereby corrected as shown below:

ON THE TITLE PAGE

Item 75, the country of residence for the inventor Brian Wong should read (CA)

Signed and Sealed this

First Day of December, 2009

David J. Kappos

David J. Kappos
*Director of the United States Patent and Trademark Office*